US012484654B2

(12) United States Patent
Halvorsen

(10) Patent No.: US 12,484,654 B2
(45) Date of Patent: Dec. 2, 2025

(54) SKATES AND METHOD FOR MANUFACTURING SKATES

(71) Applicant: Finn Halvorsen, Moss (NO)

(72) Inventor: Finn Halvorsen, Moss (NO)

( * ) Notice: Subject to any disclaimer, the term of this patent is extended or adjusted under 35 U.S.C. 154(b) by 0 days.

(21) Appl. No.: 19/050,367

(22) Filed: Feb. 11, 2025

(65) Prior Publication Data

US 2025/0176659 A1 Jun. 5, 2025

Related U.S. Application Data

(63) Continuation of application No. PCT/NO2023/060028, filed on Aug. 2, 2023.

(51) Int. Cl.

| | |
|---|---|
| ***A43B 5/16*** | (2006.01) |
| ***A43B 7/14*** | (2022.01) |
| ***A63C 1/02*** | (2006.01) |
| ***A63C 1/42*** | (2006.01) |

(52) U.S. Cl.

CPC ..... *A43B 5/1641* (2013.01); *A43B 7/14* (2013.01); *A63C 1/02* (2013.01); *A63C 1/42* (2013.01)

(58) Field of Classification Search

CPC ..... A63C 1/02; A63C 1/42; A43B 5/1641; A43B 7/14

See application file for complete search history.

(56) References Cited

U.S. PATENT DOCUMENTS

| | | | | | |
|---|---|---|---|---|---|
| 4,126,323 | A * | 11/1978 | Scherz | A43B 5/1666 | 36/97 |
| 4,835,885 | A | 6/1989 | Hoshizaki et al. | | |
| 4,998,358 | A * | 3/1991 | Girardelli | A43B 3/26 | 36/117.3 |
| 5,199,726 | A * | 4/1993 | Willett | A43B 5/1641 | 280/611 |
| 5,669,160 | A * | 9/1997 | Pozzebon | A43B 5/0405 | 36/115 |
| 5,673,448 | A * | 10/1997 | Lang | A43B 19/00 | 36/117.6 |
| 6,105,975 | A * | 8/2000 | Shum | A63C 1/32 | 280/11.12 |
| 7,021,663 | B1 * | 4/2006 | Moran | A43B 5/18 | 280/11.12 |
| 7,316,083 | B2 * | 1/2008 | Labonte | A43B 5/1666 | 36/119.1 |
| 9,878,229 | B2 | 1/2018 | Lefebvre et al. | | |
| 2016/0192729 | A1 | 7/2016 | Rastello | | |
| 2019/0380426 | A1 | 12/2019 | Sun et al. | | |
| 2020/0390195 | A1 | 12/2020 | Sun et al. | | |
| 2024/0109263 | A1 * | 4/2024 | Labonte | A43B 5/1666 | |

FOREIGN PATENT DOCUMENTS

| | | |
|---|---|---|
| JP | S5035857 Y1 | 10/1975 |
| WO | 9744104 A1 | 11/1997 |

OTHER PUBLICATIONS

Norwegian Search report issued on Mar. 17, 2023, for application No. 20220867.

* cited by examiner

*Primary Examiner* — Brian L Swenson

(74) *Attorney, Agent, or Firm* — Nath, Goldberg & Meyer; Joshua B. Goldberg

(57) ABSTRACT

A composite skate having an integral skate blade holder and an anatomically designed insole, as well as an assembly for of a skate including the composite skate and an inflatable inner boot.

9 Claims, 16 Drawing Sheets

SKATES AND METHOD FOR MANUFACTURING SKATES

FIELD OF THE INVENTION

The present invention relates to skates, parts from which skates are constructed, the design of skates, and the assembly of skates.

BACKGROUND ART

Today, several types of skates are available on the market for different purposes, such as figure skating, ice hockey, bandy, long-distance skating, long-track skating, and short-track skating.

Skates made of composite material are available in which the skate boot itself is integrally made.

Skates can be constructed with varying extents of lining depending on their purpose. In bandy and ice hockey, a rigid skate that protects against impacts is desired, which requires a thick inner lining to provide a snug fit. Figure skates, on the other hand, are formed with a less rigid shoe/boot.

Long-distance skates differ from other types of skates in that they have long skate blades and that the skate blade is mounted so as to have a point of rotation in the front of the shoe so that a clap skate is obtained.

In order to improve the fit of rigid ice hockey skates, experiments have been performed with a firm inner lining having air-inflatable heel sections so that the inner lining adapts to a foot and better secures the foot to the skate.

In general, skates are designed in such a manner that they are not optimal with respect to comfort, transfer of force, or response.

Skates usually comprise a boot part that is generally made up of several parts, as well as a skate blade holder and a skate blade. In addition, skates are provided with an insole.

SUMMARY OF THE INVENTION

It is an object of the present invention to provide solutions that optimize the manufacturing of skates as well as the response and comfort of skates.

The object is achieved by providing a skate boot insole comprising:

a) elevated lateral edges along a perimeter of the heel section of the skate boot insole and forward up to an insole section adapted for the toe ball so that the sides of the foot are prevented from yielding and portions of the forefoot and midfoot meet firm resistance against the lateral edges when engaging therewith so that the transfer of force between the skate and the foot is optimized, and b) a front toe section extending from the insole section adapted for the toe ball, which toe section is bent vertically relative to a horizontal line so that an angle $\alpha$ is formed between the toe section of the insole and the horizontal line, with said angle $\alpha$ being between 5-30°.

In an embodiment, the skate boot insole may have an angle $\alpha$ of between 15-20°.

The skate boot insole may be adapted for being fixedly mounted to a molded skate boot.

The description discloses and discusses how an inner boot of a skate boot can be provided, said inner boot being adapted for being treaded onto the foot of a skater like a sock, the toe region of which is open to ensure unrestricted toe movement, said inner boot being formed with airtight flexible inner walls and airtight flexible outer walls so that one or more airtight compartments are obtained, said one or more airtight compartments being provided with a valve so that the one or more airtight compartments are air-inflatable.

The inner boot may have an opening adapted for the Achilles tendon and the lower part of a lower leg so that the inner boot can be treaded onto a foot via the opening and towards the open toe section of the inner boot. The tensile strength of the inner wall does not have to be constant across the surface of the inner wall, which may also be true for the outer wall of the inner boot.

Also disclosed is a skate boot made of composite materials, at least comprising:

a) one right lateral part made of a composite material formed so as to appear as a right half section of a boot, b) one left lateral part made of a composite material formed so as to appear as a left half section of a boot, and c) one skate boot insole, wherein the right lateral part is assembled with the left lateral part with the skate boot insole being interposed between the right and left lateral parts so that a skate boot having a skate boot insole is obtained.

The right and left lateral parts can be adapted so as to overlap each other in the forefoot region and at the back in the heel section so that the right and left lateral parts can be secured together by fastening means. Said fastening means may be one or more of: adhesive, welding, bolts, or rivets.

In the lower part thereof, the skate boot may include a longitudinal slot adapted for the attachment of a skate blade. The skate boot may also include holes for the threaded attachment of the skate blade.

In an area from the lower part thereof adjacent to the skate blade attachment slot, the skate boot may be internally filled with a polymer foam up to the insole.

The right and left boot parts comprise one of the following materials or a combination of the following materials: carbon and aramid.

The right and left lateral parts may further be provided with a recess extending from the forefoot to the rear foot, said recess being adapted for the installation of the skate boot insole so that the heel section of the skate boot insole is positioned between one and four centimeters higher than the toe ball section of the skate boot insole.

A skate assembly is disclosed, at least comprising:

a) one skate boot made of composite materials, said skate boot at least comprising:

b) one skate boot insole having a front toe section that is bent vertically relative to a horizontal line so that an angle $\alpha$ is formed between the insole toe section and the horizontal line, said angle $\alpha$ being between 5-30°, c) one removable cover arranged as a tongue attachable to cover an opening in the skate boot, d) one or more tightening means for tightening the skate boot on a foot, e) one skate blade releasably attached to the skate boot, f) one inflatable inner boot having an open toe region.

Further advantages and embodiments of the present invention will be apparent from the appended claims.

BRIEF DESCRIPTION OF THE DRAWINGS

In order to facilitate the understanding of the invention, in the following discussion, reference is made to the attached drawings, in which.

DETAILED DESCRIPTION OF THE INVENTION

In the following, the present invention will be set forth by describing different embodiments and by referring to the accompanying drawings. However, those skilled in the art will appreciate that other solutions and modifications are encompassed by the present invention.

It is sought to describe how to provide a skate having an insole and to provide a method for manufacturing the skate. The skate is to satisfy several criteria, which criteria may include at least the following:

a) The skate must comprise a boot, which boot must include a skate blade attachment, i.e., the skate shall not comprise a separate skate blade holder,
b) The skate must have a torsionally rigid boot,
c) The boot must provide adequate impact protection,
d) The boot must be formed in one piece, or alternatively the tongue and Achilles tendon protection may be separate parts that are fitted to the boot,
e) The skate must ensure an optimal transfer of force between the skater, skate, and ice surface.
f) The skate must comprise an insole that is anatomically configured so that the phalanges are bent at least 5° in a vertical direction.
g) The skate may include an internal removable inner boot.
h) The skate and insole must provide optimal support for the soft parts of the foot so that lateral yielding under load is minimized.

In the following, the individual components included by the present skate will be discussed in more detail.

Insole

Experiments have shown that a skater gets a better kick-off if the phalanges 7 are bent upwards. If the phalanges 7 are bent upwards, then the apex of the medial longitudinal arch 9 will have a greater distance to an imaginary horizontal line 15 as compared to when the phalanges 7 are parallel to the horizontal line 15.

The shock-absorbing structures of the foot can be enhanced by preventing the fat pads of the heels from yielding laterally and medially during engagement between the heel and insole. Forming a relieving insole having high and firm edges around the heel may increase the ability of the anatomical heel pad to absorb shocks. Another effect of a sole having tight-fitting, high and thick lateral edges is that the heel is stabilized and lifted somewhat as compared to a sole with no heel support.

Figure 1:
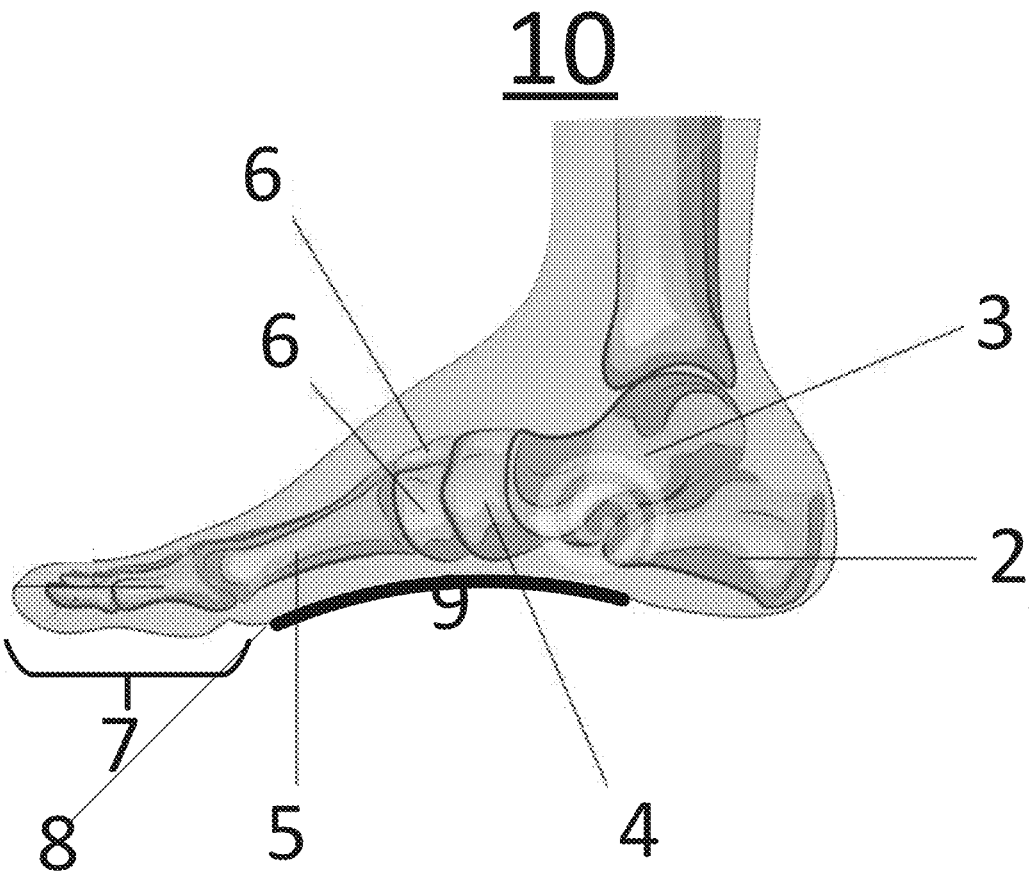
FIG. 1 shows a foot with skeletal parts.
Figure 2A:
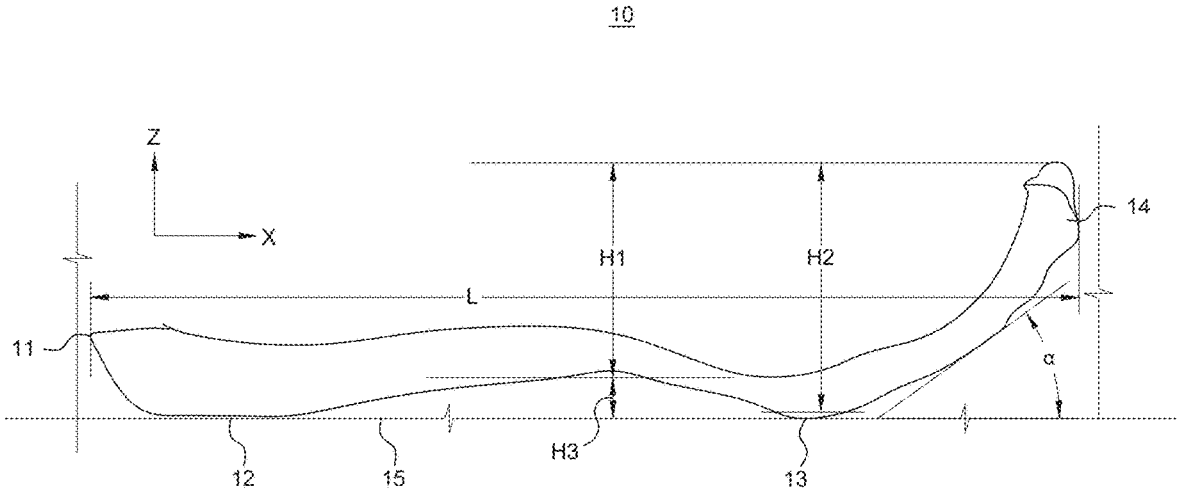
FIG. 2*a* shows a skate boot insole.
Figure 2B:
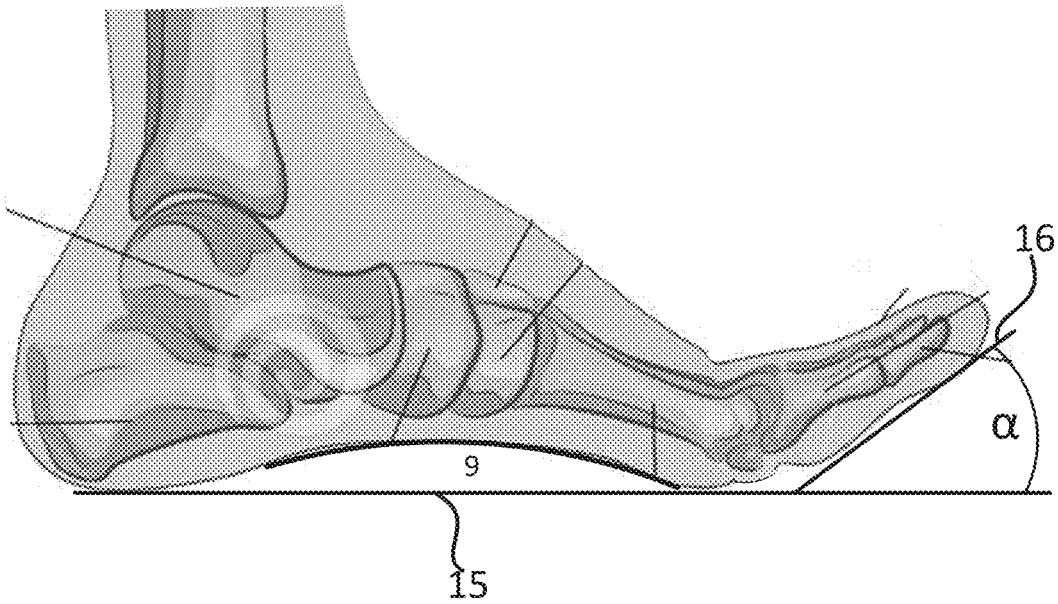
FIG. 2*b* shows a foot with skeletal parts, with the toe region being bent upwardly.
Figure 3:
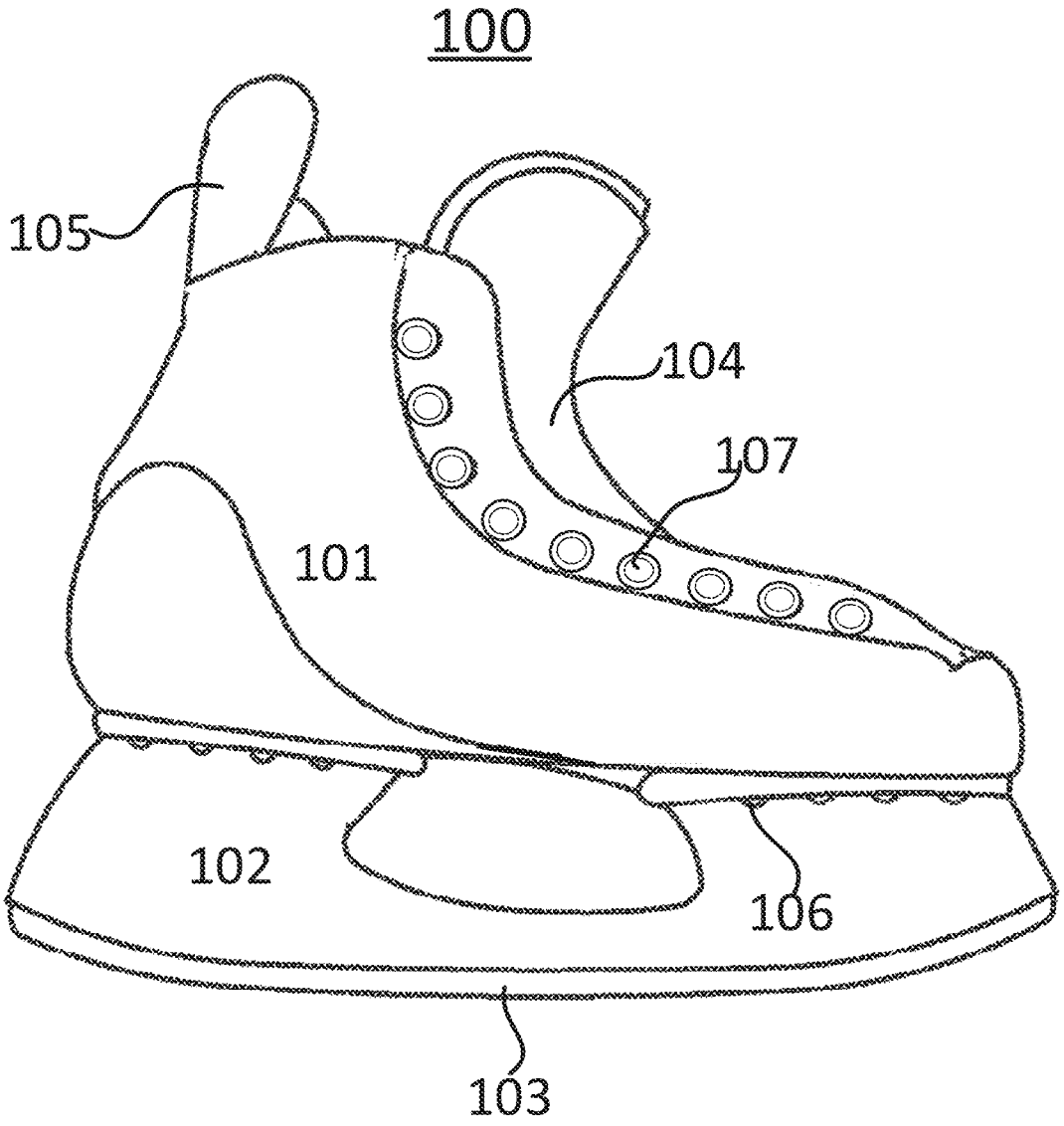
FIG. 3 shows an exemplary skate in accordance with the prior art.

FIG. 2*a* shows an exemplary insole 10 having elevated firm lateral edges for the heel section 12 and forwardly towards the metatarsals 5, indicated as the highest point of the medial arch of the insole 10. Insole 10 is bent vertically relative to a horizontal line 15 so that an angle $\alpha$ is formed between the front section 14 of insole 10 and the horizontal line 15. The bend point substantially coincides with the transition between the phalanges 7 and metatarsals 5. The angle $\alpha$ is typically between 5-20°. Experiments have shown that an angle of about 15° or more is favorable.

In conventional skates 100, the area under the forefoot is completely flat. This allows for yielding of soft parts and thus lateral movements that reduce the transfer of force from the foot to the skate. In the novel skate 30, 70, 80, insole 10 is configured in such a manner that muscles, joints and bones make direct contact with firm structures of the skate and insole, so that yielding of soft parts is prevented. Like the heel section 12, the front parts 13, 14 of insole 10 can be provided with lateral edges.

In an embodiment, insole 10 is adaptable to different skate boot shells and to the particular foot shape of the individual skater.

Arranging the insole 10 in a skate boot in such a manner that heel section 12 is located 1-3 cm higher than section 13 has turned out to give increased power in kick-offs for skaters. The installation of the insole 10 into the skate boot is described below.

Inner Boot

Skates are provided with padding on the inside of the shell of the skate boot. The padding is firm and will not adapt very much to the feet of the skater. There is a desire to provide for an optimal contact between the foot and the shell of the skate boot so that the comfort and transfer of force from the foot to the skate is optimal in that as little as possible energy is used for compressing certain areas of a padding and in that the pressure against the foot from the shell of the skate boot is distributed optimally. Skaters need the dorsiflexion and plantar flexion to be as unhindered as possible while at the same time the torsional stiffness must be good. Also, in the case of bandy or ice hockey skates, the skates must protect against impacts.

Figure 4A:
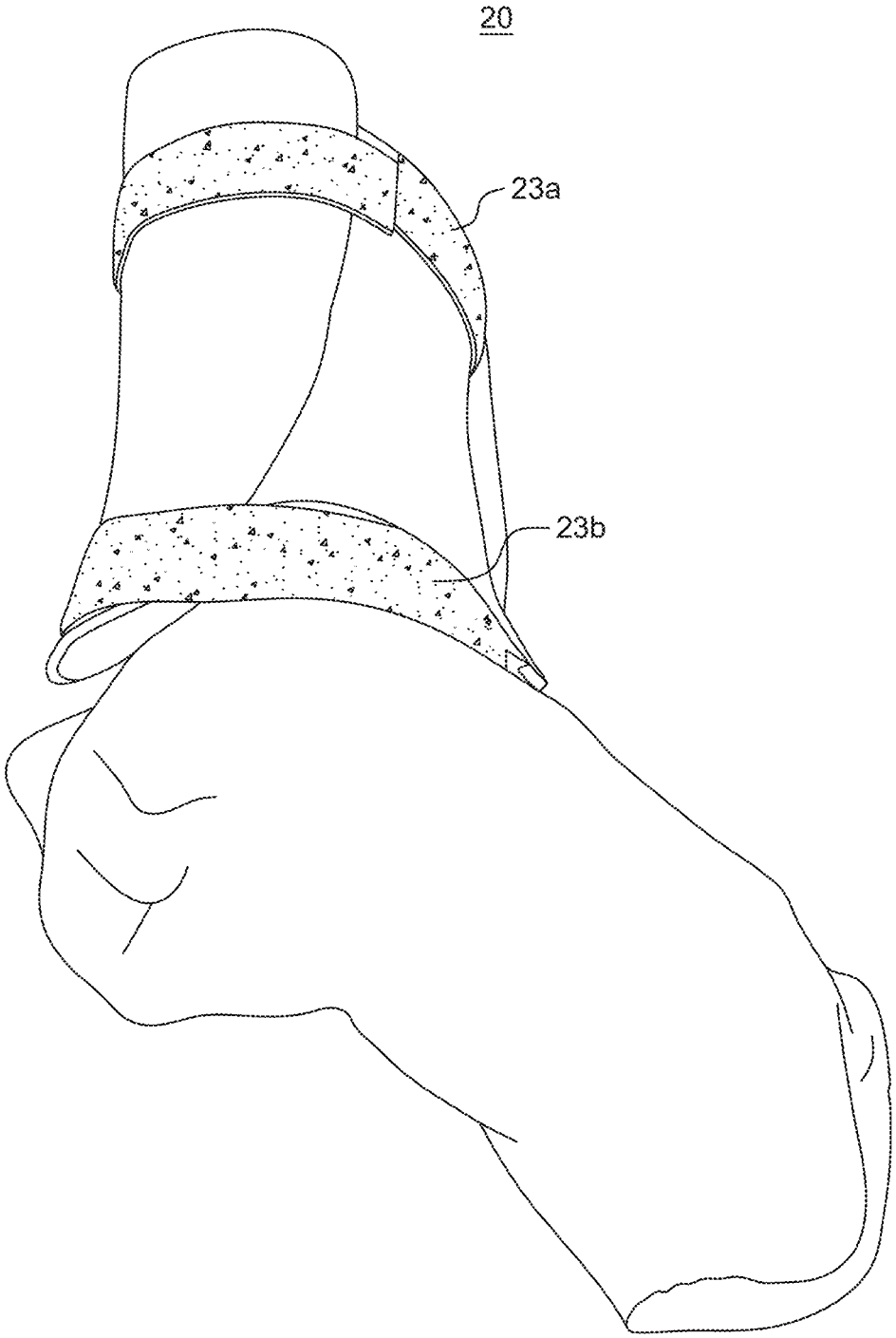
FIG. 4*a* shows an inner boot.
Figure 4B:
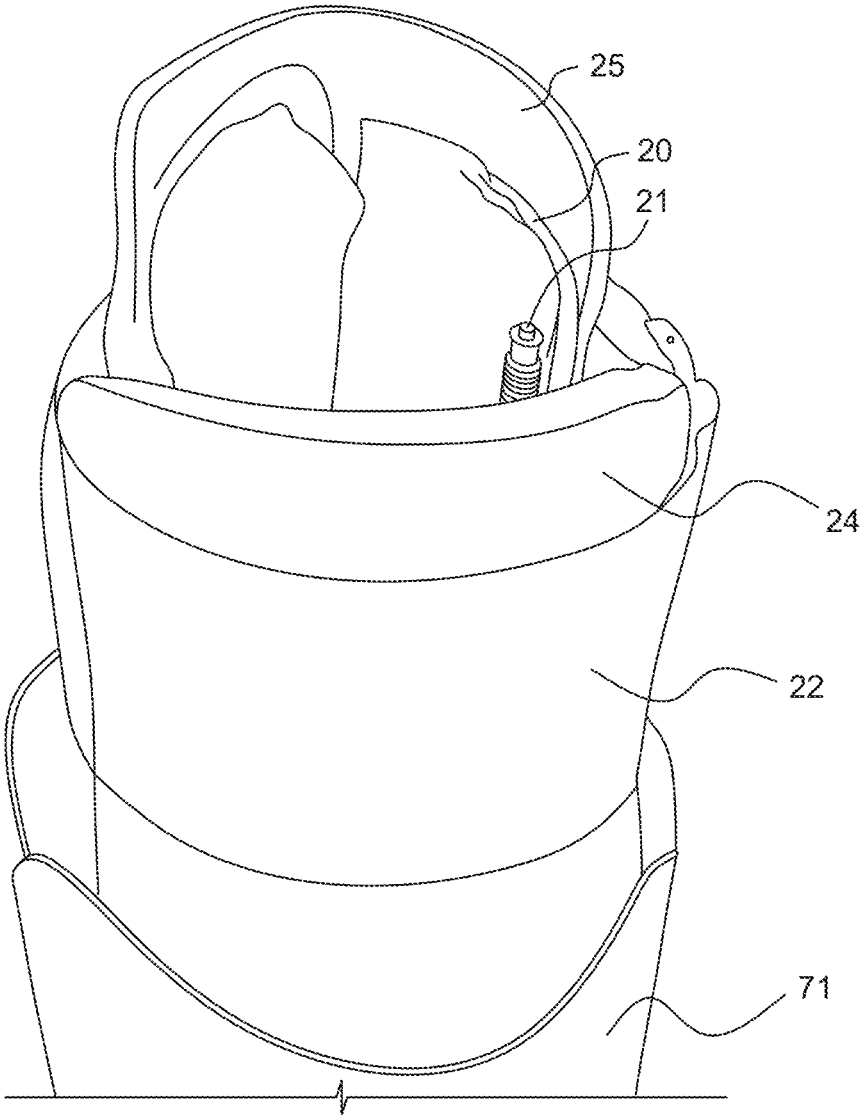
FIG. 4*b* shows an inner boot inside a skate boot having a tongue and a rear lower leg protection.
Figure 5A:
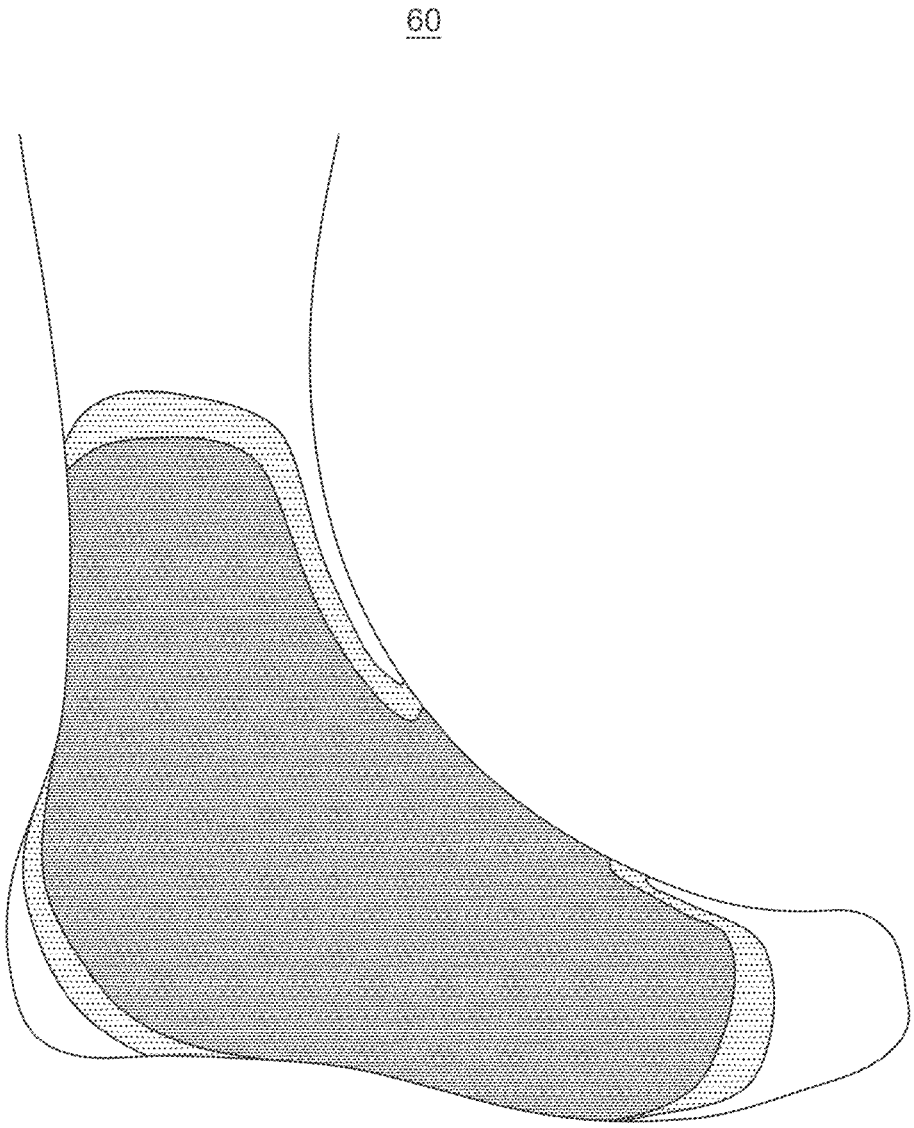
FIG. 5*a* is a lateral side view of a foot model depicting the configuration of the inner boot.
Figure 5B:
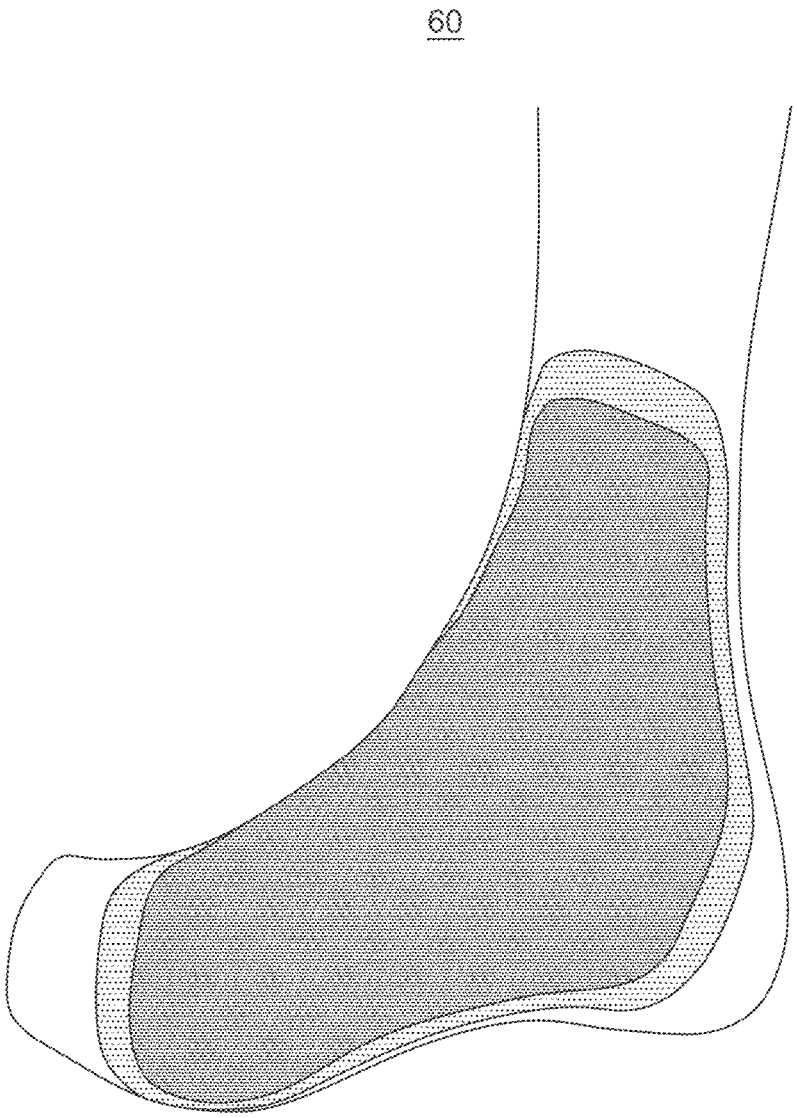
FIG. 5*b* is a medial side view of the foot model of FIG. 5*a*.
Figure 5C:
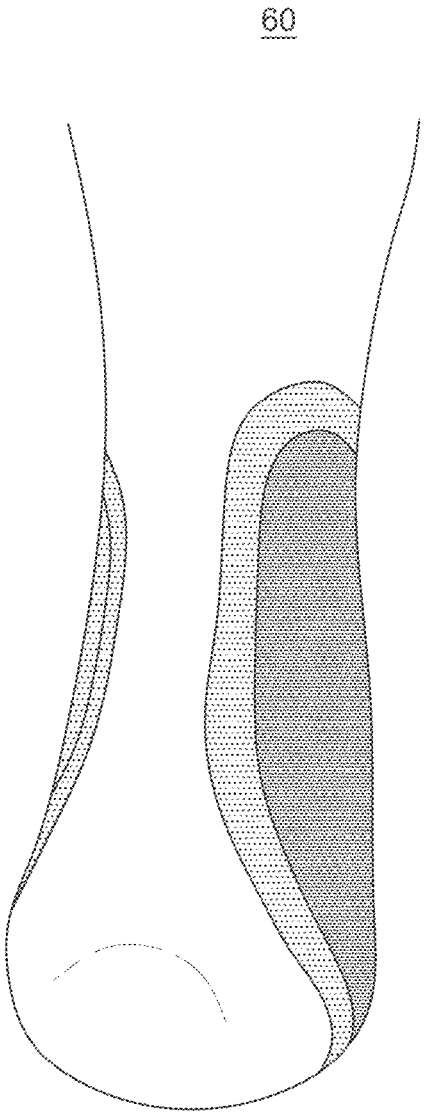
FIG. 5*c* is a rear view of the foot model of FIGS. 5*a* and 5*b* depicting the configuration of the inner boot—the upper part is straight cut, the lower part is adapted to the shape of the heel to easily enter the inner boot and at the same time provide a stable and firm hold on the ankle.
Figure 5D:
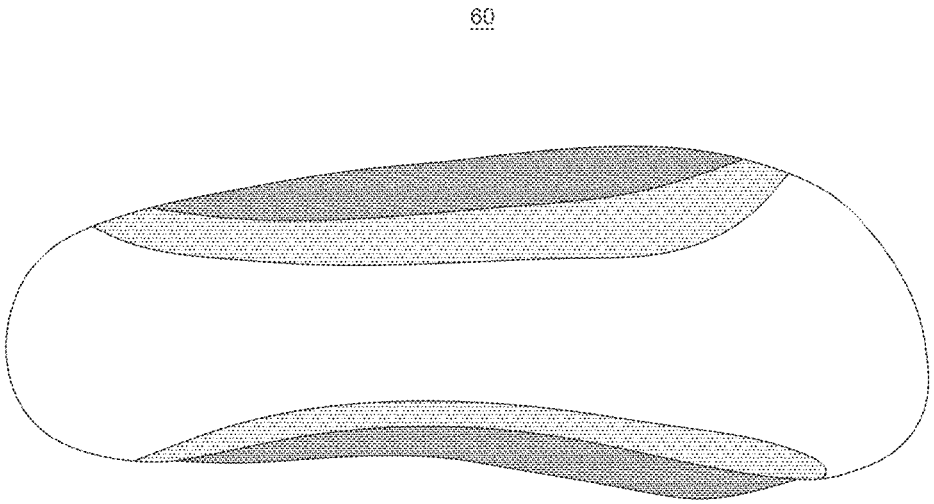
FIG. 5*d* is a bottom view of the foot model of FIGS. 5*a*-5*c* depicting the configuration of the inner boot—the dark area is inflatable, the light area represents an elastic material being adaptable to different foot shapes, the light area is not inflatable.

In FIGS. 4*a* and 4*b*, an elastic inner boot 20 is shown. Inner boot 20 is treaded onto the skater's foot. Inner boot 20 resembles a sock in which the opening into which the foot is inserted is in the back at the location of the Achilles tendon and lower part of the back of the lower leg. The toe region is open to allow for powerful toe movements and to ensure blood flow in the foot.

When the inner boot 20 has been slipped on, then the skate 30 is put on, after which a cover 71 and a tongue 24 can be attached to the skate boot 30. A protective insert 25 for protecting the back of the lower leg and Achilles tendon is arranged at the back. The protective insert 25 and tongue 24 can be fixed/secured using a lock, shown in the drawings as Velcro. When skate 30 has been put on, then inner boot 20 can be inflated, as shown in FIG. 4*b* by the inner boot 20 being provided with a valve 21. The tensile strength of the internal and external walls of the inner boot can be varied according to the regions of the foot with which the inner boot engages during use. With this, dorsal and plantar flexion can be ensured. That is, movements of the lower leg (tibia/fibula) forwards and backwards with return of energy are permitted, whereas medial and lateral movements are restricted.

The inner boot can be formed using elastic materials such as nitrile, Latex, silicone, and rubber, for example.

Further, pressure across the instep region can ensure good contact with the insole 10, making the skate "fit as if molded to the foot."

Inner boot 20 may be provided with one or more fasteners 23*a*, 23*b* able to secure the inner boot 20 to the foot. In FIGS. 4*a* and 4*b*, the fasteners are shown in the form of Velcro straps.

When combined with insole 10, inner boot 20 helps preventing soft parts of a foot from yielding medially and laterally, which is particularly noticeable in that parts of the foot are prevented from moving sideways inside the boot, providing a more direct transfer of force between the foot and the boot.

When the inflated inner boot 20 presses the foot inwards, this will keep bones and joints together, which, together with the fact that soft parts do not move/yield laterally and medially, allows a skater to stop, turn and change direction faster than if conventional skates were used.

Skate Boot

Currently, carbon skates are available in which the boot part is not provided with an outer sole mounted thereon. Such "mono-frame" skates are intended to provide a light and rigid skate boot. These skates include a skate blade holder fixed to the skate boot by way of rivets. A disadvantage of having the blade holder as a separate part is that it will detach from the skate boot when used toughly. Moreover, the solution with a separate blade holder will not be optimal with respect to rigidity and thus transfer of force from the skate to the ice.

The skate/skate boot 30, 70, 80 shown in FIGS. 6*a*-8 depicts a skate boot in which the boot itself is able to hold the skate blade, thus reducing the number of critical parts, reducing the weight, and increasing the rigidity.

In an embodiment, the area from the lower part 33 of the skate boot 30, 70 and 80 is filled with foam up to the insole.

In the drawings, the composite skate boot 30 is made from carbon and aramid. The reinforcing fibers are tailorable in that the reinforcing fibers of different layers of carbon fiber and aramid can be angled in order to obtain tensile strength, rigidity, flexibility, and protection in desired areas of the composite skate boot 30.

Figure 6A:
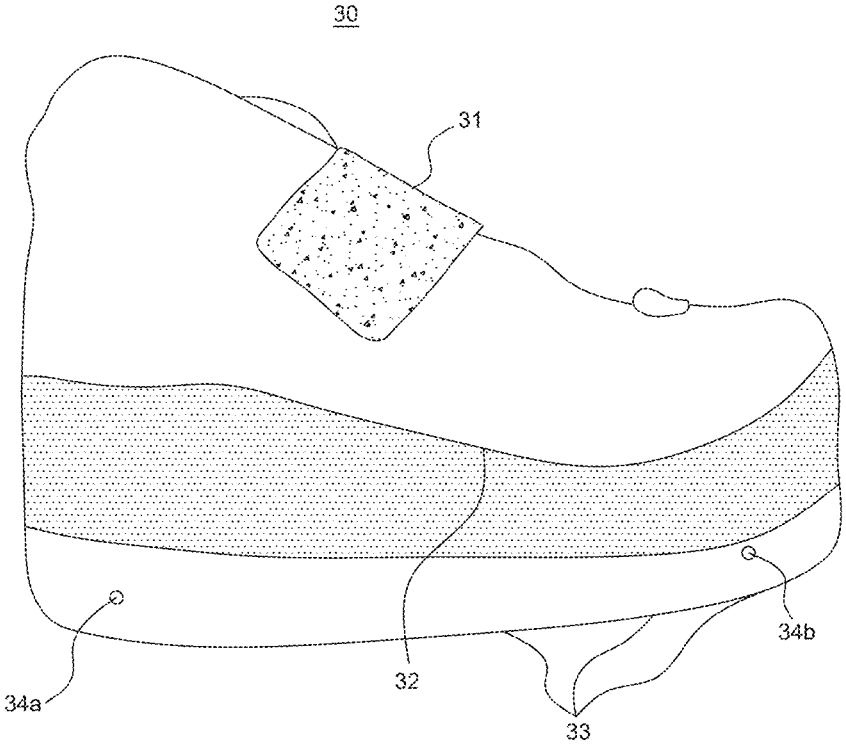
FIG. 6*a* is a side view of a skate boot.

FIG. 6*a* is a side view of a skate boot 30. The skate boot is provided with tightening means 31 in the form of a Velcro strap. The Velcro strap is shown as an example only and other tightening means can be used, such as those used for cycling shoes, or the type of buckles known from alpine boots, for example.

The figure shows a line 32 indicating the contours of an insole 10. It can be seen from the figure that the heel section is positioned significantly higher than the toe ball section. Also seen is the bend of the insole 10 from the balls of the toes to the tips of the toes. At the bottom of the figure, mounting holes 34*a* and 34*b* are shown. Said mounting holes are intended for the attachment of a skate blade.

However, the skate blade may also be attached in other ways. The threaded attachment is exemplary.

Figure 6B:
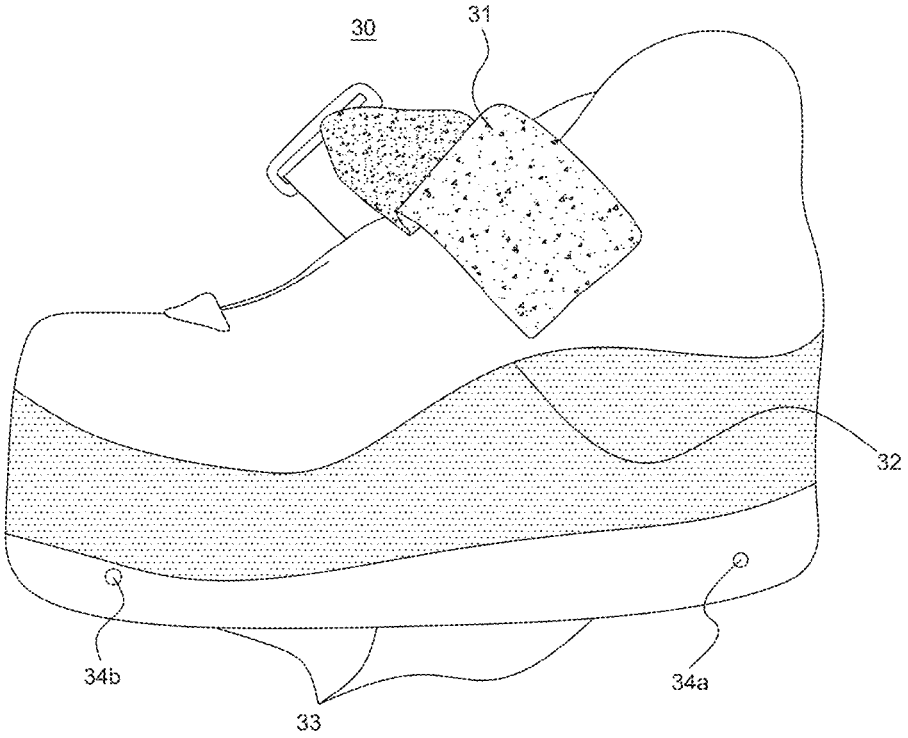
FIG. 6*b* is a side view of a skate boot as seen from the opposite side of FIG. 6*a*.

FIG. 6*b* is a side view of a skate boot 30 as seen from the opposite side of FIG. 6*a*. The figure shows the line 32 indicating the contour of an insole 32. The figure clearly shows tightening means 31 in the form of Velcro.

Figure 7A:
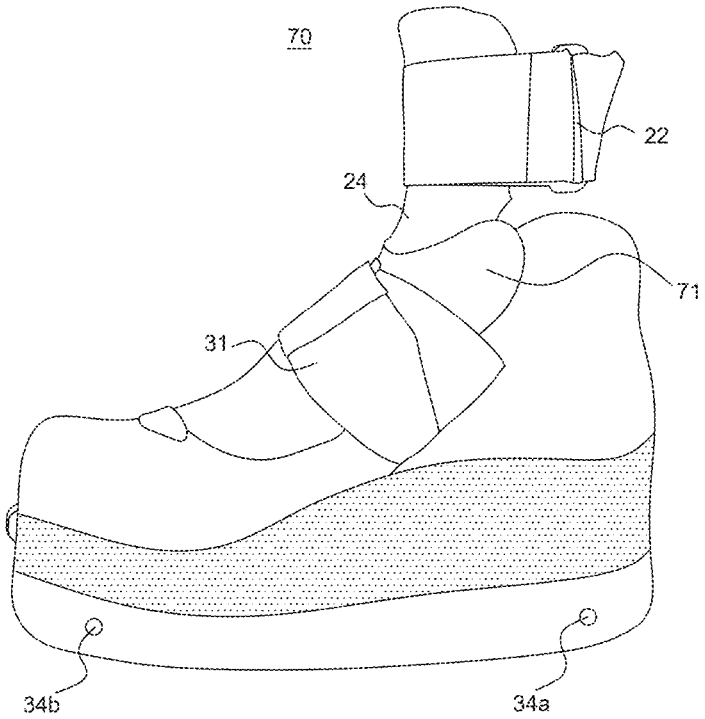
FIG. 7*a* shows side view of a skate boot including a cover, a lock for securing/fixing the cover, herein shown as a Velcro, a tongue having a lock for securing the tongue as well as a protective insert for the back of the lower leg and Achilles tendon having a lock.

FIG. 7*a* shows a skate boot 70, which skate boot 70, in addition to skate 30, includes a cover 71 and a tongue 24 attached to skate boot 30 and able to be tightened around a lower leg by way of a lock, such as a Velcro 22. The cover 71, covering an opening in the skate boot into which the foot is inserted, provides impact and shock protection, provides a firm hold in the push phase of the foot, and serves to reinforce the structure of the skate.

A front part of an inner boot 20 having fasteners 23*a*, 23*b* is inserted into the skate while being worn on the feet of a skater.

Figure 7B:
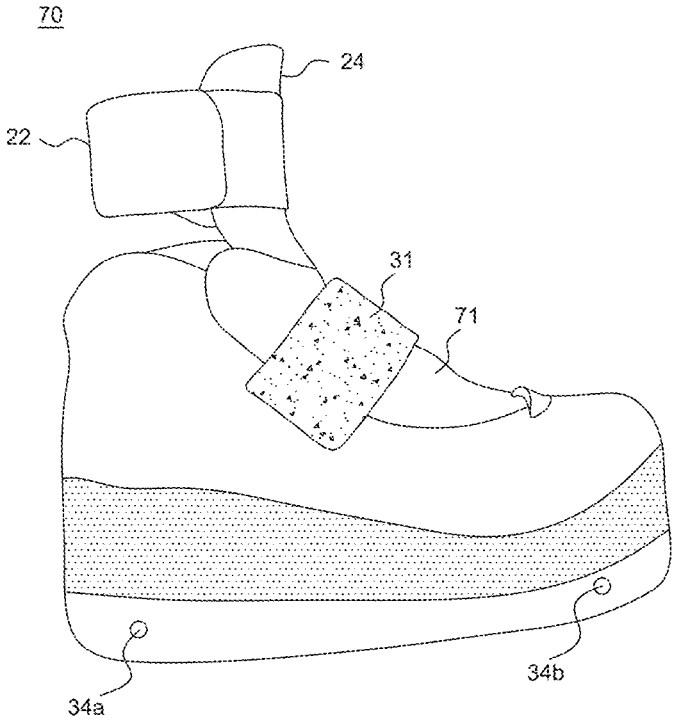
FIG. 7*b* is a side view of the skate boot of FIG. 7*a* as seen from the opposite side of FIG. 7*a*.

FIG. 7*b* shows the same skate boot 70 as FIG. 7*a*, as seen from the opposite side.

Figure 7C:
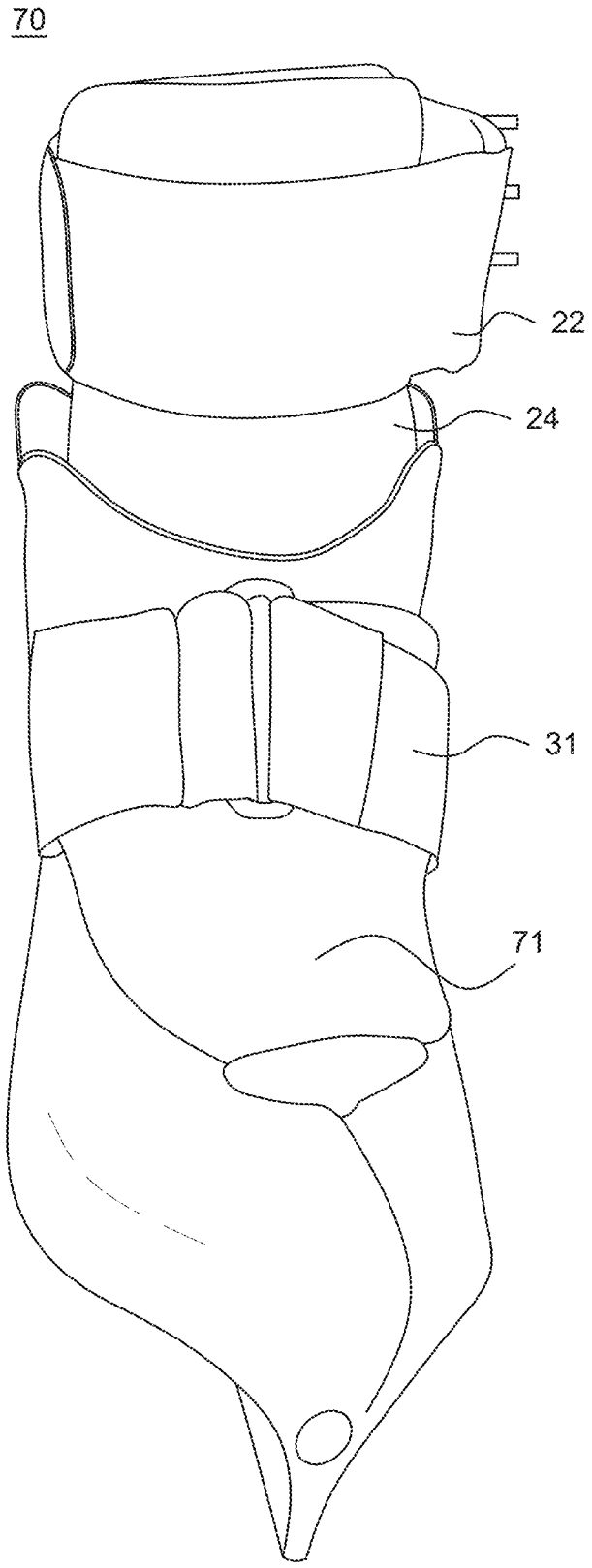
FIG. 7*c* is a side view of the skate boot of FIGS. 7*a* and 7*b* as seen from a different side than FIGS. 7*a* and 7*b*.

FIG. 7*c* is a front view of skate boot 70 in which the cover 71 as well as the lock 31 for securing/mounting the cover 71 to the skate 30 are clearly seen. Tongue 24 with the associated lock 22 for securing tongue 24 is also shown.

Figure 8:
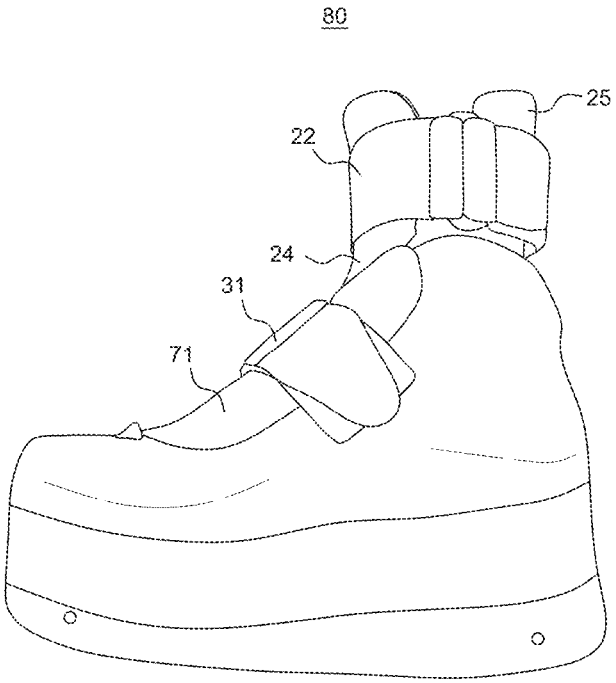
FIG. 8 shows the skate boot of FIGS. 7*a*-7*c* with a protective insert for the back of the lower leg.

FIG. 8 shows a skate including a cover, tongue and insert for protecting the back lower leg as the skate will appear in use.

The skate boot itself can consist of three parts, that is, two lateral parts assembled with an insole 10 interposed therebetween. The lateral parts may overlap in front, at the back, and across the forefoot, see FIG. 7*c*. The parts can be secured together by way of adhesive bonding or welding and bolting.

The skate boot structure can be strengthened with bolts, which also secure the skate blade contacting the ice, and in that the insole 10 is adhesively bonded or welded to the inner side of the skate.

A skate 30 as shown in FIGS. 6*a*-8 may, for example, be manufactured by injection molding. For a customized fit, heat molding can be considered. For users with special requirements, the skate boot and insole can be tailored to the feet. Materials that can be used alone or in combinations are, for example: carbon fiber, carbotanium, aramid, dyneema, glass fiber, nylon, and other composite materials suitable for the manufacture of skate boots.

Various resins such as epoxy, vinyl ester, polyester, etc. can be used in combination with the above-mentioned reinforcing fibers.

Alternative Embodiments of the Skate Boot

The skate can be manufactured by simple injection molding of plastic without any reinforcing fibers, and it can also be made so as to be heat-moldable on the foot. Alternative embodiments include attaching the skate blade directly into the lower part of the skate body as indicated in FIGS. 6*a*-7*c*. In addition, an insole 10 will be used with the inner boot.

It is to be understood that the tongue and lower back leg protecting insert will not be usable with all types of skates. Different requirements apply to skates for different uses.

Skate Blade

The skate blade is a thin (1 to 3 mm thick) metal bar mountable to the skate boot 30, 70, 80 by way of bolts via bolt holes 34*a* and 34*b*.

The skate blade may have a parabolic outer (lateral) side and a linear medial side, alternatively the inner (medial) side may be parabolic while the lateral side is linear/flat. In a variant embodiment, the skate blade may have parabolic lateral and medial sides.

The thinnest portion of the skate blade is in the area in which the line of gravity hits the ice when the skater is vertically balanced.

LIST OF REFERENCE NUMERALS

| | |
|---|---|
| 1 | Foot |
| 2 | Heel bone (calcaneus) |
| 3 | Ankle bone (talus) |
| 4 | Scaphoid bone (naviculare) |
| 5 | Metatarsals (ossa metatarsalia) |
| 6 | Wedge bones (ossa cuneiformia) |
| 7 | Toe bones (phalanges) |
| 8 | Toe ball |
| 9 | Medial longitudinal arch |
| 10 | Insole |
| 11 | Rear part of heel section of insole 10 |
| 12 | Insole heel section, |
| 13 | Insole section adapted for the toe balls |
| 14 | Front part of the insole adapted for the phalanges, bent at an angle α. |
| 15 | Horizontal line |
| 16 | Upper side of the angle between the toes and the horizontal line 15 |
| 20 | Inner boot |
| 21 | Valve for inflating the inner boot inflatable parts, |
| 22 | Lock for securing a tongue 24, such as Velcro straps |
| 23a | Upper lock for the inner boot, shown in the form of Velcro. |
| 23b | Lower lock for the inner boot, shown in the form of Velcro. |
| 24 | Tongue for protecting the front of the lower leg, providing freedom of movement so that the front of the lower leg is forward bendable, |
| 25 | Protective insert for the back of the lower leg and Achilles tendon. |
| 30 | Skate boot having a torsionally rigid composite one-piece shell-shown herein as a carbon boot. |
| 31 | Lock for securing/attaching the lid, shown herein as a Velcro strap. |
| 32 | Line showing contours of an insole |
| 33 | Lower part of skate 30, with skate blade attachment grooves. |
| 34a | Rear mounting holes for the threaded mounting of the skate blade. |
| 34b | Front mounting holes for the threaded mounting of the skate blade. |
| 60 | Foot model for designing an inner boot. |
| 70 | Skate boot with the front part of the inner boot |
| 71 | Cover |
| 80 | Composite skate without a skate blade. |
| 100 | Prior art skate |
| 101 | Skate boot |
| 102 | Skate blade holder |
| 103 | Skate blade |
| 104 | Tongue |
| 106 | Rivets for attaching the skate blade holder to the skate boot |
| α | Angle between the phalanges and the horizontal line in an active position, that is, when the foot is engaged with insole 10. |
| H1 | Vertical distance from the apex of the medial longitudinal arch of the insole to the apex of the insole-at the front tip of the toe. |
| H2 | Vertical distance from the toe ball section of the insole to the apex of the insole-at the front tip of the toe. |
| H3 | Vertical distance from the horizontal line 15 to the highest point of the medial longitudinal arch. |
| L | Total horizontal length of the insole |

The invention claimed is:

1. A skate boot insole comprising:

a. elevated lateral edges along a perimeter of a heel section of the skate boot insole and forward up to an insole section adapted for a toe ball so that fat pads of a user's heel are completely or partially prevented from yielding laterally and medially during engagement between the user's heel and the skate boot insole, and so that sides of a user's foot are prevented from yielding, and b. a front toe section that is bent vertically relative to a horizontal line so that an angle α is formed between a toe section of the skate boot insole and the horizontal line, said angle α being between 5-30°.

2. The skate boot insole according to claim 1 wherein said angle α is between 15-20°.

3. The skate boot insole according to claim 1 wherein the skate boot insole is adapted for being fixedly mounted to a molded skate boot.

4. An inner boot of a skate boot, said inner boot being adapted for being treaded onto a foot of a skater like a sock, a toe region of which is open to ensure unrestricted toe movement, said inner boot being formed with airtight flexible inner walls and airtight flexible outer walls so that one or more airtight compartments are obtained, said one or more airtight compartments being provided with a valve so that said one or more airtight compartments are air-inflatable.

5. The inner boot according to claim 4 wherein the inner boot has an opening adapted for an Achilles tendon and a lower part of a lower leg so that the inner boot can be treaded onto the foot via the opening and towards the open toe section of the inner boot.

6. The inner boot according to claim 4 wherein a tensile strength of an inner wall is not constant across a surface thereof.

7. The inner boot according to claim 4 wherein a tensile strength of an outer wall varies across a surface thereof.

8. A skate assembly comprising at least:

a) one skate boot, said skate boot comprising at least:

i. one skate boot insole having a front toe section that is bent vertically relative to a horizontal line so that an angle α is formed between the front toe section of the skate boot insole and the horizontal line, said angle α being between 5-30°, ii. one removable cover arranged on an instep part covering an opening in the skate boot, iii. one or more tightening means for tightening the skate boot on a foot, iv. one skate blade releasably attached to the skate boot, b) one inflatable inner boot having an open toe region.

9. The skate assembly according to claim 8 wherein the skate boot is made of one of the following materials: composite material and injection-molded plastic.

* * * * *